US008887945B2

(12) United States Patent
Kao

(10) Patent No.: US 8,887,945 B2
(45) Date of Patent: Nov. 18, 2014

(54) FOLDABLE CONTAINER MODULE

(71) Applicant: Highplus International Co., Ltd., New Taipei (TW)

(72) Inventor: Chih-Hung Kao, New Taipei (TW)

(73) Assignee: Highplus International Co., Ltd., New Taipei ( * ) Notice: Subject to any disclaimer, the term of this patent is extended or adjusted under 35 U.S.C. 154(b) by 0 days.

(21) Appl. No.: 13/727,598

(22) Filed: Dec. 27, 2012

(65) Prior Publication Data

US 2014/0183204 A1 Jul. 3, 2014

(51) Int. Cl.

| | |
|---|---|
| ***B65D 6/28*** | (2006.01) |
| ***B65D 8/18*** | (2006.01) |
| ***B65D 21/032*** | (2006.01) |
| ***B65D 43/03*** | (2006.01) |
| ***B65D 90/08*** | (2006.01) |
| ***B65D 90/00*** | (2006.01) |

(52) U.S. Cl.

CPC ..... *B65D 90/00* (2013.01)
USPC ..... 220/666; 220/23.87; 220/23.91; 220/505; 220/506; 220/738; 220/4.03; 220/671; 206/218; 206/514; 229/4.5; 229/405

(58) Field of Classification Search

USPC ..... 220/6, 574–575, 8, 23.87, 23.91, 506, 220/505, 503, 738, 4.03, 666, 218, 671; 206/218, 514; 229/4.5, 400, 117.22, 229/405

See application file for complete search history.

(56) References Cited

U.S. PATENT DOCUMENTS

| | | | | |
|---|---|---|---|---|
| 5,351,879 | A * | 10/1994 | Liu et al. | 229/104 |
| 5,725,117 | A * | 3/1998 | Berjis | 220/4.03 |
| 6,237,845 | B1 * | 5/2001 | Hashimoto et al. | 229/400 |
| 7,182,242 | B2 * | 2/2007 | Cai | 229/400 |
| 2002/0074247 | A1 * | 6/2002 | Tremblay | 206/223 |
| 2006/0219722 | A1 * | 10/2006 | Benak | 220/575 |
| 2010/0314387 | A1 * | 12/2010 | Cassese et al. | 220/4.01 |

* cited by examiner

*Primary Examiner* — Fenn Mathew
*Assistant Examiner* — Jennifer Castriotta
(74) *Attorney, Agent, or Firm* — Apex Juris, pllc; Tracy M. Heims

(57) ABSTRACT

A foldable container module includes a body and a foldable container. The body has a sidewall and a room. The foldable container has a panel, multiple folding line sets formed on the panel, and a joint. The foldable container can be transformed by folding along the multiple folding line sets. The joint connects to the sidewall of the body. The foldable container module can be held in one hand by a user, and the other hand of the user can swing freely or take the solid food from the foldable container, such that the user can also suck the liquid from the body by the straw at the same time. Moreover, when the foldable container module is to be stored, the user can fold the foldable container along the multiple folding line sets to reduce a volume of the foldable container.

7 Claims, 9 Drawing Sheets

FOLDABLE CONTAINER MODULE

BACKGROUND OF THE INVENTION

1. Field of the Invention

The present invention relates to a foldable container module, and more particularly to a foldable container module to contain solid and liquid separately.

2. Description of the Prior Arts

When a user buys both solid food and drink, it is inconvenient to hold a container filled with solid food by one hand and hold the drink by the other hand, such that the user has no free hand to enjoy eating and drinking or take any other object. For example, when the users enjoy buffets at picnics, sports meetings, banquets, and some formal occasions, they have to hold a dinner plate by one hand, and hold a drink by the other hand, such that they have no free hand to take and enjoy food. It is inconvenient to put down the drink, and the users have to worry the drink will fall and spill off.

SUMMARY OF THE INVENTION

To overcome the above-mentioned shortcomings, the present invention provides a foldable container module to overcome the aforementioned inconvenience.

To achieve the objective, the foldable container module in accordance with the present invention includes a body and a foldable container.

The body has a bottom, an upper rim, a sidewall formed from the bottom to the upper rim, and a room defined by the bottom and sidewall for accommodating a liquid.

The foldable container is an annular slice, and has an outer edge, an inner edge, a panel connected to the outer edge and the inner edge, multiple folding line sets formed on the panel, and a joint connected to the inner edge. The perimeter of the outer edge is longer than that the inner edge. The multiple folding line sets are arranged on the panel and extend from the inner edge to the outer edge, such that the foldable container can be transformed by folding along the multiple folding line sets. The joint is an annular slice. An outer rim of the joint connects to the inner edge of the foldable container and the joint connects to the sidewall of the body.

Preferably, the foldable container is flexible and made of materials including, but not limited to, polyethylene, polypropylene, polyvinylchloride, thylene vinyl acetate copolymer, paper, and silica gel.

Preferably, the panel of the foldable container extends away relative to the upper rim of the body to form a containing space.

Preferably, the multiple folding line sets are arranged equidistantly on the panel, and the multiple folding line sets are vertical to the outer edge and the inner edge respectively.

Preferably, a height from the inner edge to the outer edge of the foldable container is equal to a height from a connecting site of the joint and the sidewall to the upper rim of the body.

Preferably, each folding line set further includes a first line segment and two second line segments, wherein the two second line segments are on opposite sides of the first line segment.

Preferably, distances from any one of the second line segments to the first line segment decrease progressively along a direction from the outer edge to the inner edge.

More preferably, the two second line segments intersect with the first line segment at the inner edge.

Preferably, the two second line segments of each folding line set overlap each other, the first line segment protrudes out of the panel to form multiple protrusions, and a portion of the panel between the two second line segments of each folding line set is laminated to the sidewall of the body.

More preferably, the protrusions can be laminated to the panel of the foldable container by turning the protrusions left or right.

In another preferred embodiment of the present invention, the multiple folding line sets are annular and parallel with the outer edge and the inner edge; the multiple folding line sets are arranged equidistantly on the panel; each folding line set has a perimeter larger than that of its adjacent folding line set which is closer to the inner edge with respect to said each folding line set.

More preferably, each folding line set further has a first line segment and a second line segment, wherein the first line segment and the second line segment are both annular; the perimeter of the first line segment is larger than the perimeter of the second line segment, and the each folding line set further has a crease formed between the second line segment of the folding line set and the first line segment of an adjacent folding line set. The average perimeter of the crease increases progressively from the inner edge to the outer edge of the foldable container.

More preferably, the panel of the foldable container extends laterally away relative to the body to form a containing space.

Preferably, the panel of the foldable container is parallel to planes containing the bottom and the upper rim of the body.

In another preferred embodiment of the present invention, the foldable container module further has a film, and the film corresponds to and covers the upper rim of the body, such that the tank can be formed as a closed space in the body.

More preferably, the material of the film includes, but not limited to, polyethylene and polypropylene.

When the foldable container module is in use, the container module can contain solid foods and liquid respectively, which means that the liquid can be contained in the tank of the body; the solid foods can be contained in the containing space of the foldable container. A straw can be inserted from the film to the tank of the body, such that a user can hold the body by a hand, and the other hand can swing freely or take the solid food from the foldable container, that is, the user can also suck the liquid from the body by the straw at the same time. Moreover, when the foldable container module is to be stored, the user can fold the foldable container along the multiple folding line sets to reduce a volume of the foldable container for transportation and storage.

Other objectives, advantages and novel features of the invention will become more apparent from the following detailed description when taken in conjunction with the accompanying drawings.

DETAILED DESCRIPTION OF THE PREFERRED EMBODIMENTS

Figures 1, 1A:
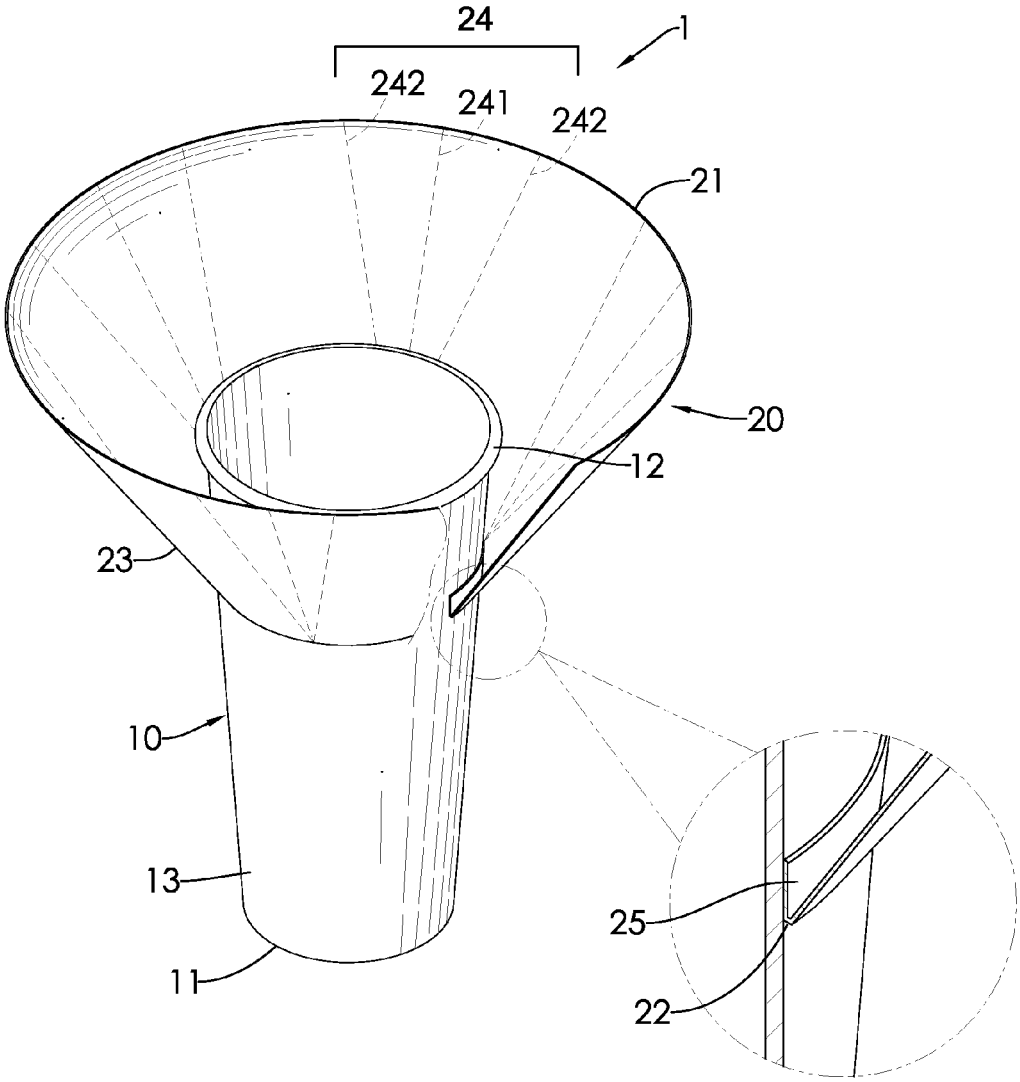
FIG. 1 is a perspective view of a first embodiment of a foldable container module in accordance with the present invention.
FIG. 1A is a partially enlarged view of the foldable container module in FIG. 1.
Figure 2:
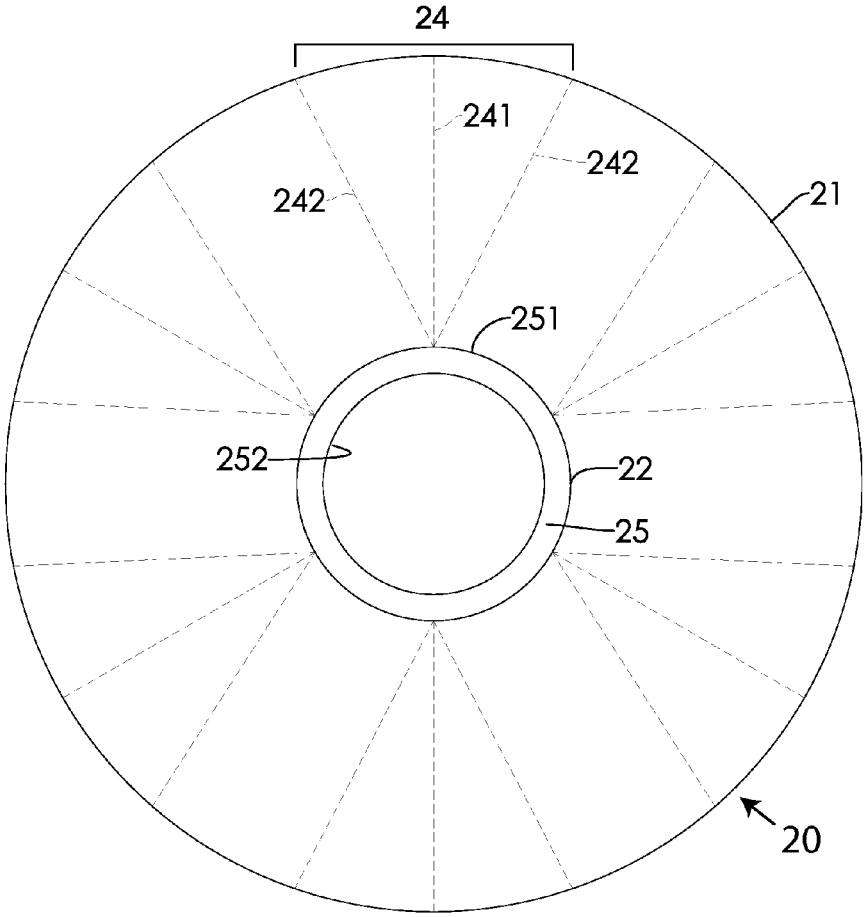
FIG. 2 is a plan view of a foldable container in the first embodiment.

With reference to FIGS. 1, 1A and 2, a first embodiment of a foldable container module 1 in accordance with the present invention has a body 10 and a foldable container 20.

The body 10 has a bottom 11, an upper rim 12, a sidewall 13 formed from the bottom 11 to the upper rim 12, and a room defined by the bottom 11 and sidewall 13 for accommodating a liquid.

The foldable container 20 is made of materials including, but not limited to polyethylene, polypropylene, polyvinylchloride, ethylene vinyl acetate copolymer, paper, and silica gel. The foldable container 20 is ring, and has an outer edge 21, an inner edge 22, a panel 23 connected to the outer edge 21 and the inner edge 22, multiple folding line sets 24 formed on the panel 23, and a joint 25 connected to the inner edge 22.

Figure 3:
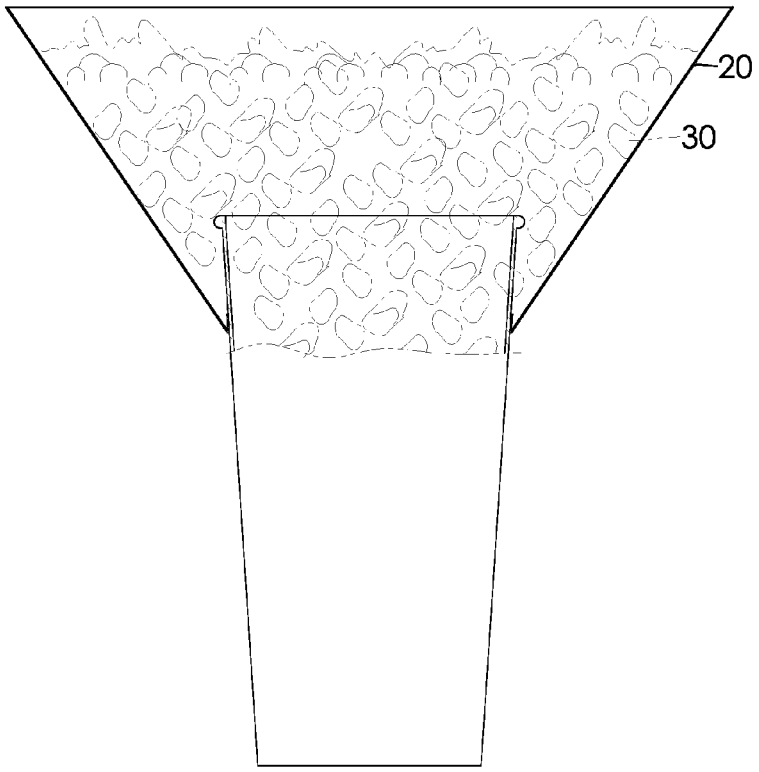
FIG. 3 is an operational side view of the first embodiment of the foldable container module.

The perimeter of the outer edge 21 is longer than that of the inner edge 22. The multiple folding line sets 24 are arranged equidistantly on the panel 23 and extend from the inner edge 22 to the outer edge 21. Moreover, the multiple folding line sets 24 are vertical to the outer edge 21 and the inner edge 22 respectively, such that the foldable container 20 can be transformed by folding along the multiple folding line sets 24. Each folding line set 24 further has a first line segment 241 and two second line segments 242, wherein the two second line segments 242 are on opposite sides of the first line segment 241. The two second line segments 242 intersect the first line segment 241 at the inner edge 22. Distances from any one of the second line segments 242 to the first line segment 241 of each folding line set 24 decrease progressively from the outer edge 21 to the inner edge 22. The joint 25 is a ring which has an outer rim 251 and an inner rim 252. The outer rim 251 connects to the inner edge 22 of the foldable container 20. The perimeter of the inner rim 252 is equal to the perimeter of the upper rim 12 of the body 10. The joint 25 connects to the sidewall 13 of the body 10. The panel 23 of the foldable container 20 extends away relative to the upper rim 12 of the body 10. With reference to FIG. 3, the foldable container 20 can form a containing space to contain solid foods 30 such as popcorns, marshmallows, shrimp chips, cakes, candies or puffs.

Figure 4:
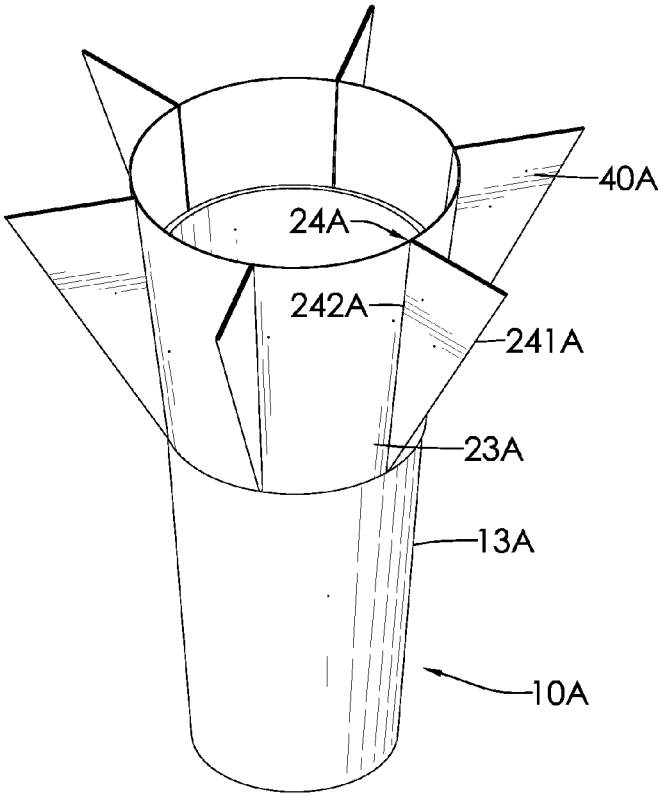
FIG. 4 is an operational side view of a second embodiment of the foldable container module.
Figure 5:
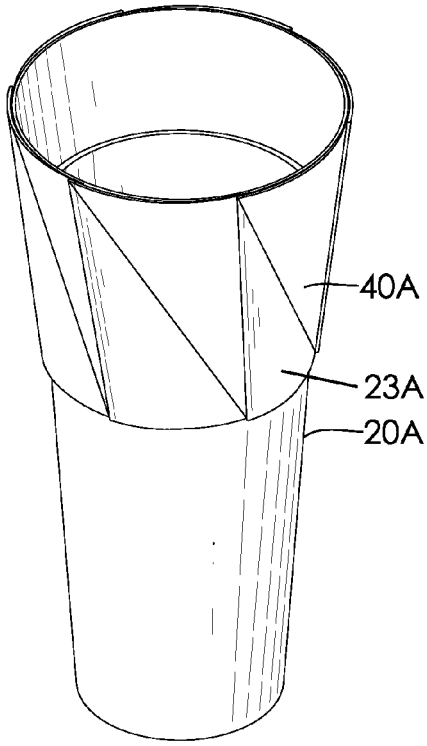
FIG. 5 is another perspective view of the second embodiment of the foldable container module.

When a second preferred embodiment of the present invention is in use, with reference to FIG. 4, the two second line segments 242A of each folding line set 24A overlap each other, such that the first line segment 241A protrudes from the panel 23A to form multiple protrusions 40A. The panel 23A is laminated to the sidewall 13A of the body 10A between the two second line segments 242A of each folding line set 24A. With reference to FIG. 5, the protrusions 40A can be laminated to the panel 23A of the foldable container 20A by turning the protrusions 40A left or right.

Figure 6:
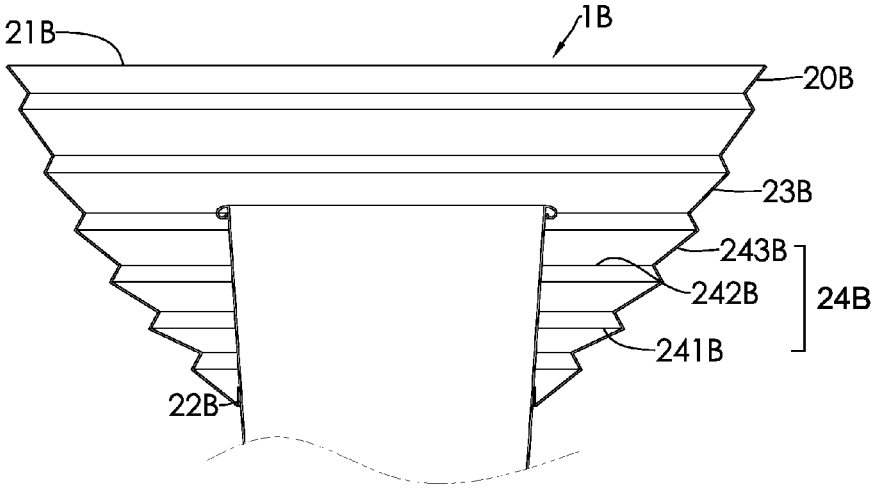
FIG. 6 is a cross-sectional side view of a third embodiment of the foldable container module.
Figure 7:
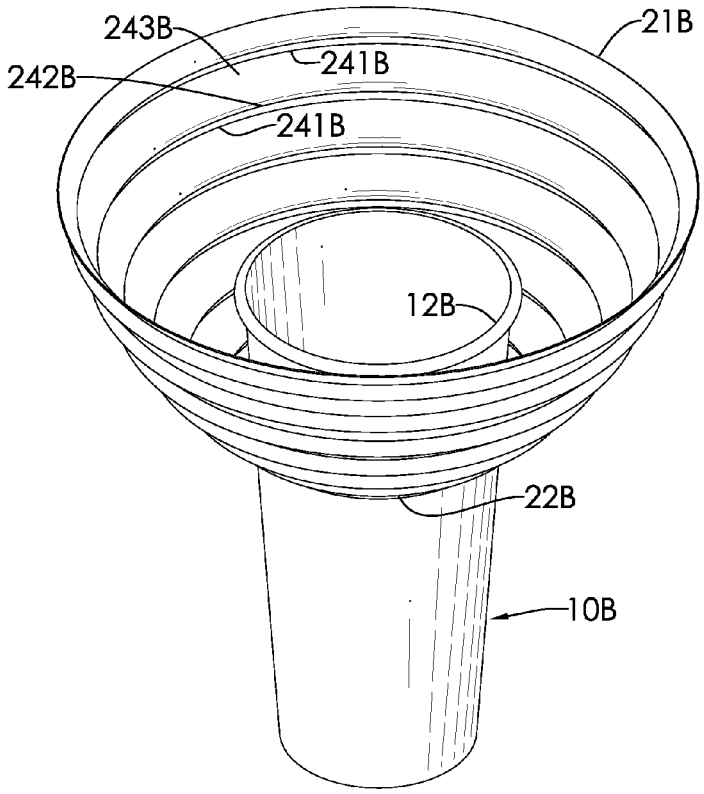
FIG. 7 is a perspective view of the third embodiment of the foldable container module.

In a third preferred embodiment of the present invention, with reference to FIGS. 6 and 7, the multiple folding line sets 24B of the foldable container 20B of the foldable container module 1B are annular. The multiple folding line sets 24B are parallel with the outer edge 21B and inner edge 22B. The multiple folding line sets 24B are arranged equidistantly on the panel 23B. Each folding line set 24B has a perimeter larger than that of its adjacent folding line set 24B which is closer to the inner edge 22B with respect to said each folding line set 24B. The panel 23B of the foldable container 20B extends away relative to the upper rim 12B of the body 10B to form a containing space. Each folding line set 24B further has a first line segment 241B and a second line segment 242B, wherein the first line segment 241B and the second line segment 242B are both annular. The perimeter of the first line segment 241B is larger than the perimeter of the second line segment 242B. A crease 243B is formed between the second line segment 242B of each folding line set 24B and the first line segment 241B of an adjacent folding line set 24B. The average perimeter of the crease 243B increases progressively from the inner edge 22B to the outer edge 21B of the foldable container 20B.

Figure 8:
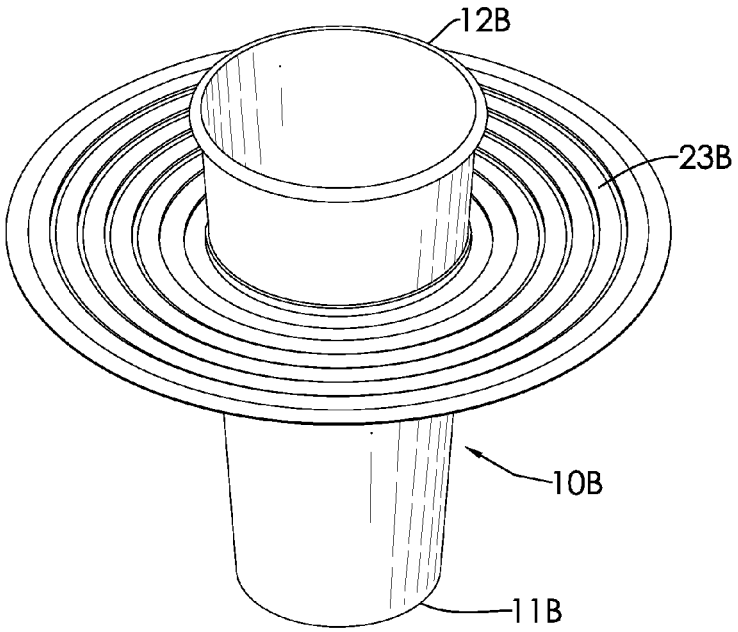
FIG. 8 is an operational side view of a fourth embodiment of the foldable container module.

In a fourth preferred embodiment of the present invention, with reference to FIG. 8, the panel 23B of the foldable container 20B extends laterally away relative to the body 10B and in parallel with planes respectively containing the bottom 11B and the upper rim 12B of the body 10B.

Figure 9:
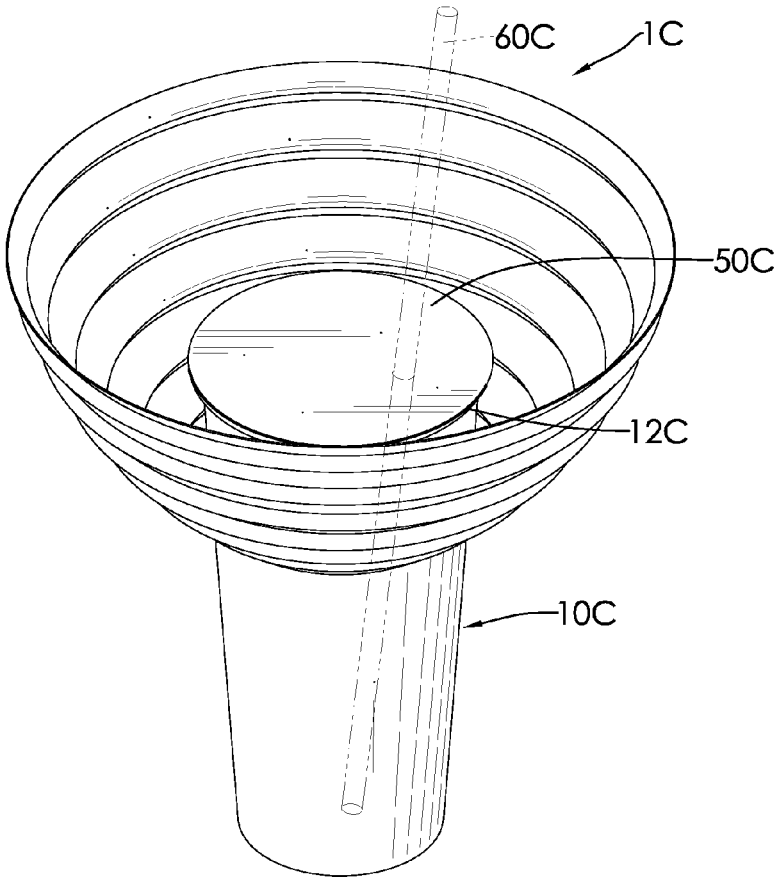
FIG. 9 is a perspective view of a fifth embodiment of the foldable container module.

In a fifth preferred embodiment of the present invention, with reference to FIG. 9, the foldable container module 1C further has a film 50C. The film 50C corresponds to and covers the upper rim 12C of the body 10C, such that the tank can be formed as a closed space in the body 10. The material of the film 50C is aluminum foil or plastic such as polyethylene or polypropylene.

When the fifth preferred embodiment of the present invention is in use, a straw 60C can be inserted from the film 50C to the tank of the body 10C, such that an end of the straw 60C is in the tank. The other end of the straw 60C can protrude from the upper rim 12C of the body 10 and the foldable container 20C. The user can hold the body 10C by a hand, and the other hand can swing freely or take the solid food 30C from the foldable container 20C, such that the user can also suck the liquid from the body 10C by the straw 60C at the same time.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A foldable container module comprising:

a body having:

a bottom;

an upper rim; and a sidewall formed from the bottom to the upper rim;

a foldable container being a ring, and having:

an inner edge;

an outer edge, wherein a perimeter of the outer edge is greater than a perimeter of the inner edge;

a panel connected to the outer edge and the inner edge;

multiple folding line sets formed on the panel and extending from the inner edge to the outer edge, wherein each folding line set includes a first line segment and two second line segments, wherein the two second line segments are on opposite sides of the first line segment, and the two second line segments of each folding line set overlap each other such that the first line segment protrudes out of the panel to form multiple protrusions, and a portion of the panel between the two second line segments of each folding line set is laminated to the sidewall of the body; and a joint connected to the body and having an outer rim connected to the sidewall of the body.

2. The foldable container module as claimed in claim 1, wherein the foldable container is flexible and made of polyethylene, polypropylene, polyvinylchloride, ethylene vinyl acetate copolymer, paper, or silica gel.

3. The foldable container module as claimed in claim 1, wherein the panel of the foldable container extends away relative to the upper rim of the body to form a containing space.

4. The foldable container module as claimed in claim 1, wherein the multiple folding line sets are arranged equidistantly on the panel, and the multiple folding line sets are vertical to the outer edge and the inner edge respectively.

5. The foldable container module as claimed in claim 1, wherein distances from any one of the second line segments to the first line segment decrease progressively along a direction from the outer edge to the inner edge.

6. The foldable container module as claimed in claim 1, wherein the two second line segments intersect with the first line segment at the inner edge.

7. The foldable container module as claimed in claim 1, wherein the protrusions can be laminated to the panel of the foldable container by turning the protrusions left or right.

* * * * *